US011669052B2

(12) United States Patent
Ninomiya

(10) Patent No.: US 11,669,052 B2
(45) Date of Patent: Jun. 6, 2023

(54) TIMEPIECE AND CONTROL METHOD OF A TIMEPIECE

(71) Applicant: Seiko Epson Corporation, Tokyo (JP)

(72) Inventor: Masaya Ninomiya, Matsumoto (JP)

(73) Assignee: SEIKO EPSON CORPORATION

( * ) Notice: Subject to any disclaimer, the term of this patent is extended or adjusted under 35 U.S.C. 154(b) by 716 days.

(21) Appl. No.: 16/816,395

(22) Filed: Mar. 12, 2020

(65) Prior Publication Data

US 2020/0293002 A1 Sep. 17, 2020

(30) Foreign Application Priority Data

Mar. 13, 2019 (JP) ..... JP2019-045757

(51) Int. Cl.
*G04F 5/04* (2006.01)
*G04D 7/00* (2006.01)
*G04G 3/02* (2006.01)

(52) U.S. Cl.
CPC ..... *G04F 5/04* (2013.01); *G04D 7/003* (2013.01); *G04G 3/02* (2013.01)

(58) Field of Classification Search
CPC . G04F 5/04; G04D 7/003; G04G 3/02; G04G 3/04
See application file for complete search history.

(56) References Cited

U.S. PATENT DOCUMENTS 4,272,840 A 6/1981 Morozumi et al.
5,771,180 A * 6/1998 Culbert ..... G04G 3/02 702/179
7,382,680 B2 * 6/2008 Nakano ..... G11C 11/005 365/233.1
8,443,131 B2 5/2013 Nagao et al.
(Continued)

FOREIGN PATENT DOCUMENTS

JP S60-173492 A 9/1985
JP 2001-143488 A 5/2001
(Continued)

*Primary Examiner* — Edwin A. Leon
*Assistant Examiner* — Kevin Andrew Johnston
(74) *Attorney, Agent, or Firm* — Harness, Dickey & Pierce, P.L.C.

(57) ABSTRACT

A timepiece reduces power consumption while maintaining required precision. The timepiece has a frequency divider that frequency divides an oscillation signal and outputs a reference signal; nonvolatile memory that stores information related to a temperature characteristic of the oscillation frequency of the crystal oscillator; multiple registers; a temperature measuring circuit; an evaluation circuit; and a temperature compensation circuit. The temperature compensation circuit reads the information from one of the registers and corrects the reference signal based on the read information and the temperature measurement information when the evaluation circuit determines the information stored in the multiple registers is the same; and when the evaluation circuit determines the information stored in the multiple registers is different, reads the information from the non-
(Continued)

volatile memory, stores the read information in the multiple registers, and corrects the reference signal based on the read information and the temperature measurement information.

15 Claims, 5 Drawing Sheets

(56) References Cited

U.S. PATENT DOCUMENTS

| | | | | |
|---|---|---|---|---|
| 8,901,983 | B1 * | 12/2014 | Ruffieux | G04G 3/04 331/66 |
| 10,141,053 | B2 | 11/2018 | Toyotaka | |
| 2014/0086023 | A1 * | 3/2014 | Kasai | G04C 3/002 368/187 |
| 2017/0255167 | A1 * | 9/2017 | Yamazaki | H03B 5/364 |

FOREIGN PATENT DOCUMENTS

| | | | |
|---|---|---|---|
| JP | 2017-027506 | A | 2/2017 |
| JP | 2018-163666 | A | 10/2018 |
| WO | WO-2006-046282 | A1 | 5/2006 |

* cited by examiner

TIMEPIECE AND CONTROL METHOD OF A TIMEPIECE

BACKGROUND

1. Technical Field

The present invention relates to a timepiece and to a control method of a timepiece.

The present application claims priority based on and incorporates by reference the entire contents of Japanese Patent Application No. 2019-045757 filed in Japan on Mar. 13, 2019.

2. Related Art

Timepieces that frequency divide a reference clock signal output from a crystal oscillator circuit to produce a reference signal, and keep time based on the reference signal, are known from the literature.

The crystal oscillator circuit affects the timekeeping precision of the timepiece because the oscillation frequency changes according to the temperature characteristics of the crystal oscillator. The temperature characteristics of the crystal oscillator are also known to vary from device to device, or more specifically there are device-specific differences in the temperature characteristics.

JP-A-S60-173492 describes a timepiece that compensates for the temperature characteristics of the crystal oscillator and device-specific differences in the temperature characteristics. The timepiece described in JP-A-S60-173492 reads information related to the temperature characteristics of the crystal oscillator, and information related to the device-specific differences in the temperature characteristics, from nonvolatile memory, and applies temperature compensation to the oscillation frequency of the crystal oscillator based on this information. The timekeeping precision of the timepiece can thereby be maintained.

However, in order to maintain the required timekeeping precision, the timepiece described in JP-A-S60-173492 must apply temperature compensation at a specific interval, and the information related to the temperature characteristics of the crystal oscillator must be read from nonvolatile memory each time temperature compensation is applied. This increases current consumption and makes reducing the power consumption of the timepiece difficult.

SUMMARY

A timepiece according an aspect of the present disclosure includes: a crystal oscillator; an oscillator circuit that causes the crystal oscillator to oscillate; a frequency divider that frequency divides the oscillation signal output from the oscillator circuit, and outputs a reference signal; a nonvolatile memory that stores information related to a temperature characteristic of the oscillation frequency of the crystal oscillator; multiple registers configured to the information; a temperature measuring circuit that measures temperature and acquires temperature measurement information; an evaluation circuit configured to determine whether or not the information stored in the multiple registers is the same; and a temperature compensation circuit configured to read the information from one of the registers and correct the reference signal based on the read information and the temperature measurement information when the evaluation circuit determines the information stored in the multiple registers is the same, and when the evaluation circuit determines the information stored in the multiple registers is different, read the information from the nonvolatile memory and store the read information in the multiple registers, and correct the reference signal based on the read information and the temperature measurement information.

In a timepiece according to another aspect of the present disclosure, the nonvolatile memory includes common temperature characteristics information memory that stores common temperature characteristics information that is common to the crystal oscillator as the information; the registers include multiple common temperature characteristics information registers configured to store the common temperature characteristics information; the evaluation circuit includes a common temperature characteristics information evaluation circuit configured to determine whether or not the common temperature characteristics information stored in the multiple common temperature characteristics information registers is the same; and the temperature compensation circuit corrects the reference signal based on the common temperature characteristics information and the temperature measurement information.

In a timepiece according to another aspect of the present disclosure, the nonvolatile memory includes device difference information memory that stores device difference information related to a temperature characteristic of the crystal oscillator as the information; the registers include multiple device difference information registers that store the device difference information; the evaluation circuit includes a device difference information evaluation circuit configured to determine whether or not the device difference information stored in the multiple device difference information registers is the same; and the temperature compensation circuit corrects the reference signal based on the device difference information.

In a timepiece according to another aspect of the present disclosure, the nonvolatile memory includes common temperature characteristics information memory that stores common temperature characteristics information that is common to the crystal oscillator, and device difference information memory that stores device difference information related to a temperature characteristic of the crystal oscillator, as the information; the registers include multiple common temperature characteristics information registers configured to store the common temperature characteristics information, and multiple device difference information registers that store the device difference information; the evaluation circuit includes a common temperature characteristics information evaluation circuit configured to determine whether or not the common temperature characteristics information stored in the multiple common temperature characteristics information registers is the same, and a device difference information evaluation circuit configured to determine whether or not the device difference information stored in the multiple device difference information registers is the same; and the temperature compensation circuit corrects the reference signal based on the common temperature characteristics information, the device difference information, and the temperature measurement information.

A timepiece according to another aspect of the present disclosure also has hands configured to display time; a drive mechanism configured to drive the hands; and a drive controller configured to drive the hands by the drive mechanism based on the reference signal corrected by the temperature compensation circuit.

A timepiece according to another aspect of the present disclosure also has a spring; a generator that is driven by a drive mechanism connected to the spring and produces power; hands that connect to the drive mechanism and display time; and a regulator controller configured to control rotation of the generator based on the reference signal corrected by the temperature compensation circuit.

Another aspect of the present disclosure is a control method of a timepiece having a crystal oscillator; an oscillator circuit that causes the crystal oscillator to oscillate; a frequency divider that frequency divides the oscillation signal output from the oscillator circuit, and outputs a reference signal; a nonvolatile memory that stores information related to a temperature characteristic of the oscillation frequency of the crystal oscillator; multiple registers configured to the information; and a temperature measuring circuit that measures temperature and acquires temperature measurement information, the control method comprising steps of: determining whether or not the information stored in the multiple registers is the same; reading the information from one of the registers and correcting the reference signal based on the read information and the temperature measurement information when the information stored in the multiple registers is determined the same; and reading the information from the nonvolatile memory, storing the read information in the multiple registers, and correcting the reference signal based on the read information and the temperature measurement information when the information stored in the multiple registers is determined different.

Other objects and attainments together with a fuller understanding of the invention will become apparent and appreciated by referring to the following description and claims taken in conjunction with the accompanying drawings.

DESCRIPTION OF EMBODIMENTS

Embodiment 1

A time piece 1 according to the first embodiment of the present disclosure is described below with reference to the accompanying figures.

Figure 1:
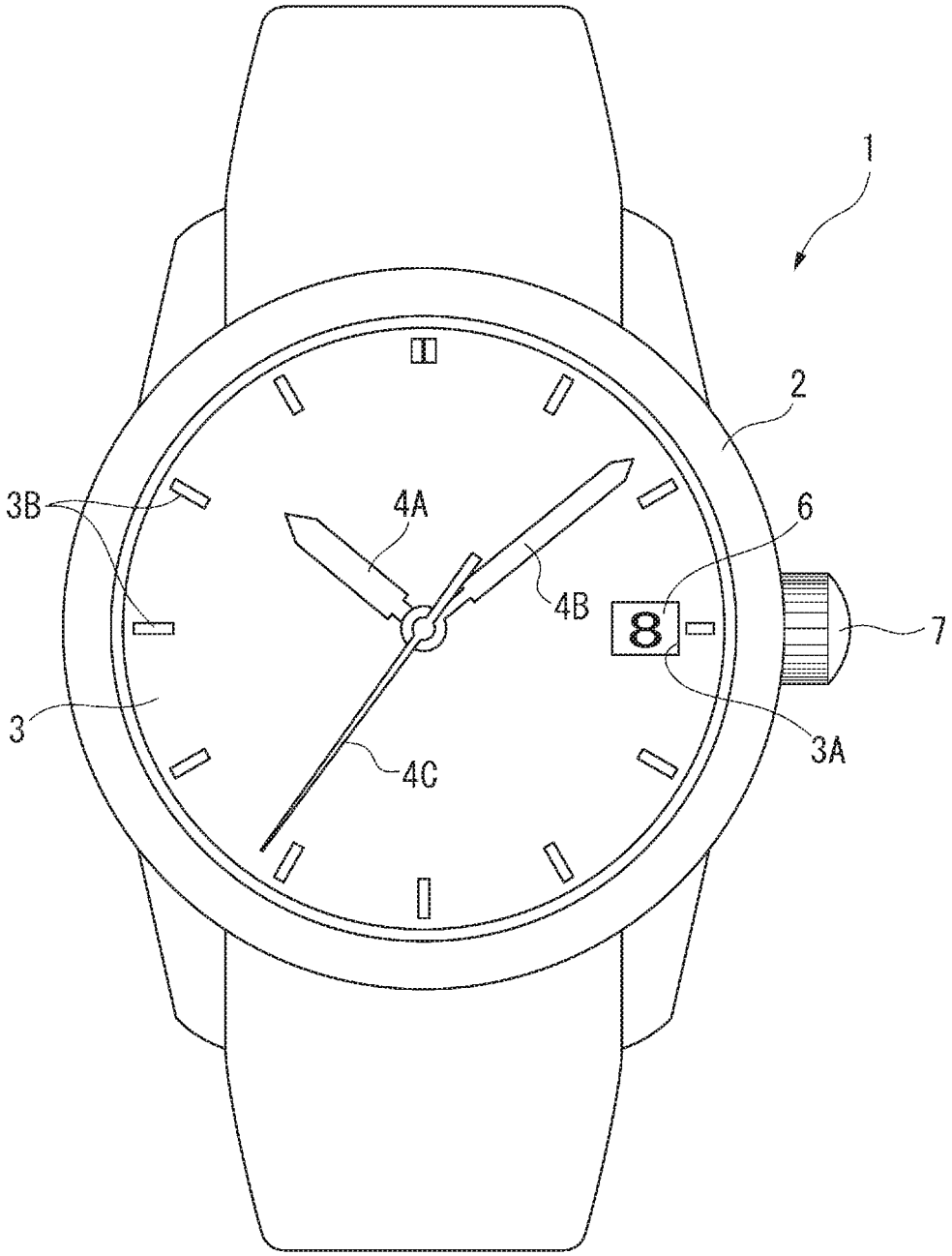
FIG. 1 is a front view of a timepiece according to the first embodiment.

FIG. 1 is a front view of the timepiece 1.

As shown in FIG. 1, the timepiece 1 is a wristwatch typically worn on the user's wrist, and has a tubular external case 2 with a dial 3 disposed on the inside circumference side of the external case 2. Of the two main openings to the external case 2, the opening on the front side is covered by the watch crystal, and the opening on the back side is covered by a back cover.

The timepiece 1 includes a movement not shown housed inside the external case 2, and an hour hand 4A, minute hand 4B, and second hand 4C used to indicate time information. A calendar window 3A is also formed in the dial 3, and a date indicator 6 can be seen through the calendar window 3A. Hour markers 3B for indicating the time are also provided on the dial 3.

A crown 7 is also disposed in the side of the external case 2. The crown 7 can be pulled from a 0 stop position, to which the crown 7 is pushed into toward the center of the timepiece 1, to a first stop position and a second stop position.

When the crown 7 is pulled out to the first stop and turned, the date indicator 6 turns and the date can be set. When the crown 7 is pulled out to the second stop, the second hand 4C stops, and when the crown 7 is then turned at the second stop the hour hand 4A and minute hand 4B can be moved to set the time. The method of adjusting the date indicator 6 and the hour hand 4A and minute hand 4B by means of the crown 7 is the same as in a conventional timepiece, and further description thereof is omitted.

Basic Configuration of the Timepiece

Figure 2:
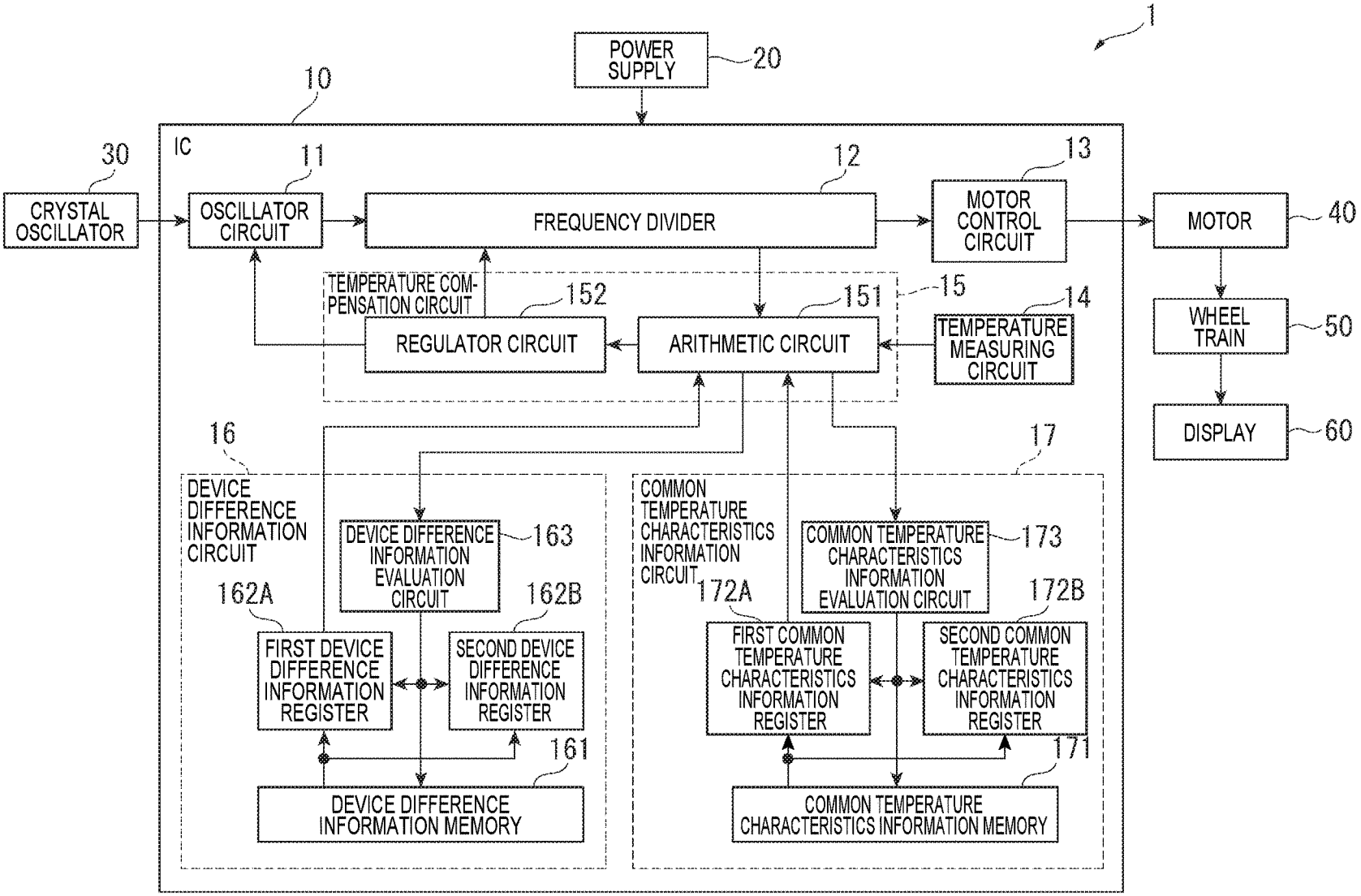
FIG. 2 is a block diagram illustrating the basic configuration of the timepiece according to the first embodiment.

FIG. 2 is a block diagram illustrating the basic configuration of the timepiece 1.

As shown in FIG. 2, the timepiece 1 is an analog quartz timepiece having an IC 10, power supply 20, crystal oscillator 30, motor 40, wheel train 50, and display 60. Note that the timepiece 1 according to this embodiment is a so-called year difference timepiece with accuracy measured in seconds per year.

The power supply 20 may be configured by a primary battery or a storage battery, and drives the IC 10 and motor 40. If the power supply 20 is a storage battery, a generator or other charging means using a solar cell or rotor is preferably also provided.

The crystal oscillator 30 is driven by an oscillator circuit 11 described below.

The motor 40 has a stator, coil, and rotor not shown, and is driven by drive current output from a motor control circuit 13 described below.

The wheel train 50 is connected to the hands 4A to 4C shown in FIG. 1. As a result, the motor 40 drives the hands 4A to 4C through the wheel train 50. Note that the motor 40 and wheel train 50 are an example of a drive mechanism in the accompanying claims.

The display 60 is configured by the hands 4A to 4C shown in FIG. 1, and displays the time.

IC

The IC 10 includes an oscillator circuit 11, a frequency divider 12, a motor control circuit 13, a temperature measuring circuit 14, a temperature compensation circuit 15, a device difference information circuit 16, and a common temperature characteristics information circuit 17. Note that IC is an abbreviation for integrated circuit.

The timepiece 1 causes the crystal oscillator 30, which is a reference signal generator shown in FIG. 2, to oscillate at a high frequency, and outputs an oscillation signal of a specific frequency (32768 Hz) generated at this high frequency to the frequency divider 12.

The frequency divider 12 frequency divides the output of the oscillator circuit 11, generates a clock signal of a specific frequency, and outputs the clock signal to the motor control circuit 13 and temperature compensation circuit 15.

The motor control circuit 13 drives the motor 40 based on the input clock signal. Note that the clock signal output from the frequency divider 12 to the motor control circuit 13 is a reference signal used as a reference for motor 40 control. The motor control circuit 13 is an example of a drive controller in the accompanying claims.

The temperature measuring circuit 14 outputs temperature measurement information T corresponding to the temperature of the environment in which the timepiece 1 is used to the temperature compensation circuit 15. Configurations using a diode or a CR oscillator circuit may be used as the temperature measuring circuit 14, and the temperature measuring circuit 14 is configured to detect the current temperature measurement information T based on an output signal that changes according to the temperature characteristics of the diode or CR oscillator circuit.

The temperature compensation circuit 15 corrects the reference signal output from the frequency divider 12 based on the temperature measurement information T output from the temperature measuring circuit 14, device difference information ID output from the device difference information circuit 16, and common temperature characteristics information CD output from the common temperature characteristics information circuit 17.

The temperature compensation circuit 15 includes an arithmetic circuit 151 and a regulator circuit 152.

The arithmetic circuit 151 calculates and outputs to the regulator circuit 152 a rate correction based on the temperature measurement information T, device difference information ID, and common temperature characteristics information CD.

The arithmetic circuit 151 includes a storage circuit such as flip-flops, and stores the temperature measurement information T output from the temperature measuring circuit 14 as stored temperature measurement information T1.

The regulator circuit 152 outputs a logical regulation signal corresponding to the compensation input from the arithmetic circuit 151, and at the compensation timing of the logical regulation, such as every 10 seconds, adjusts the rate by changing the timing of the frequency divider 12 clock. The regulator circuit 152 also adjusts the additional capacitance, that is, the oscillation capacitance, of the oscillator circuit 11 and adjusts the oscillation frequency, according to the compensation amount input from the arithmetic circuit 151. The reference signal output from the frequency divider 12 is corrected by adjusting the oscillation frequency of the oscillator circuit 11 and adjusting the rate of the frequency divider 12.

The reference signal compensation process of the 15 is described in detail below.

Common Temperature Characteristics Information Circuit

The common temperature characteristics information circuit 17 is a circuit that outputs common temperature characteristics information CD to the temperature compensation circuit 15.

Because the oscillation frequency changes according to the temperature, the crystal oscillator 30 also accordingly changes the frequency of the clock signal output from the frequency divider 12. In other words, the rate changes according to the temperature. The common temperature characteristics information circuit 17 is therefore configured to output common temperature characteristics information CD indicating how much to correct the rate at a given temperature assuming an ideal crystal oscillator 30 and an ideal temperature measuring circuit 14. Note that the common temperature characteristics information CD is an example of information in the accompanying claims.

The common temperature characteristics information circuit 17 includes common temperature characteristics information memory 171, a first common temperature characteristics information register 172A, a second common temperature characteristics information register 172B, and a common temperature characteristics information evaluation circuit 173.

The common temperature characteristics information CD is written to the common temperature characteristics information memory 171. In this embodiment the common temperature characteristics information memory 171 is configured by ROM. As a result, even when the power supply is stopped, the common temperature characteristics information memory 171 holds the common temperature characteristics information CD in memory. Furthermore, because the structure of ROM is simple, it has a high degree of integration and occupies little space.

Note that the common temperature characteristics information memory 171 is an example of a nonvolatile memory in the accompanying claims.

Note also that ROM is an abbreviation for read-only memory.

The first common temperature characteristics information register 172A and the second common temperature characteristics information register 172B are configured by flip-flops in this example, and are registers to which the common temperature characteristics information CD read from the common temperature characteristics information memory 171 is written. The first common temperature characteristics information register 172A and second common temperature characteristics information register 172B store the common temperature characteristics information CD as long as power is supplied.

More specifically, the common temperature characteristics information CD read from the common temperature characteristics information memory 171 is written to the first common temperature characteristics information register 172A as first common temperature characteristics information CD1.

The common temperature characteristics information CD read from the common temperature characteristics information memory 171 is written to the second common temperature characteristics information register 172B as second common temperature characteristics information CD2.

Note that the first common temperature characteristics information register 172A and the second common temperature characteristics information register 172B are examples of multiple registers in the accompanying claims.

The common temperature characteristics information evaluation circuit 173 is controlled by the arithmetic circuit 151 to compare the first common temperature characteristics information CD1 stored in the first common temperature characteristics information register 172A, and the second common temperature characteristics information CD2 stored in the second common temperature characteristics information register 172B.

The common temperature characteristics information evaluation circuit 173 is also controlled by the arithmetic circuit 151 to read the common temperature characteristics information CD from the common temperature characteristics information memory 171, and store the common temperature characteristics information CD in the first common temperature characteristics information register 172A as the first common temperature characteristics information CD1.

The common temperature characteristics information evaluation circuit 173 similarly stores the common temperature characteristics information CD in the second common temperature characteristics information register 172B as second common temperature characteristics information CD2.

Note that the common temperature characteristics information evaluation circuit 173 is an example of a an evaluation circuit in the accompanying claims.

Device Difference Information Circuit

The device difference information circuit 16 is a circuit that outputs the device difference information ID to the temperature compensation circuit 15.

Individual (device-specific) differences result in the crystal oscillator 30 and temperature measuring circuit 14 during the manufacturing process. As a result, the device difference information circuit 16 is configured to enable outputting device difference information ID indicating how much to compensate for individual differences from the ideal crystal oscillator 30 and ideal temperature measuring circuit 14 based on the characteristics of the crystal oscillator 30 and temperature measuring circuit 14 that are previously measured during production or inspection.

Note that the device difference information ID is an example of information in the accompanying claims.

The device difference information circuit 16 includes device difference information memory 161, a first device difference information register 162A, a second device difference information register 162B, and a device difference information evaluation circuit 163.

The device difference information ID is written to device difference information memory 161. In this embodiment, the device difference information memory 161 is configured by FAMOS. As a result, the device difference information memory 161 holds the device difference information ID in memory even when the power supply is stopped.

Furthermore, because the device difference information memory 161 is configured with FAMOS, the device difference information ID can be written to memory after the IC 10 is designed.

Note that the device difference information memory 161 is an example of a nonvolatile memory in the accompanying claims.

FAMOS is an abbreviation for floating gate avalanche injection metal oxide semiconductor.

The first device difference information register 162A and second device difference information register 162B are configured by flip-flops, for example, and are registers to which the device difference information ID read from the device difference information memory 161 is written. The first device difference information register 162A and second device difference information register 162B store the device difference information ID as long as power is supplied.

More specifically, the device difference information ID read from the device difference information memory 161 is stored in the first device difference information register 162A as first device difference information ID1.

The device difference information ID read from the device difference information memory 161 is also stored in the second device difference information register 162B as second device difference information ID2.

Note that the first device difference information register 162A and the second device difference information register 162B are examples of registers in the accompanying claims.

The device difference information evaluation circuit 163 is controlled by the arithmetic circuit 151 to compare the first device difference information ID1 stored in the first device difference information register 162A, and the second device difference information ID2 stored in the second device difference information register 162B.

The device difference information evaluation circuit 163 is also controlled by the arithmetic circuit 151 to read the device difference information ID from the device difference information memory 161, and store the device difference information ID in the first device difference information register 162A as first device difference information ID1.

Likewise, the device difference information evaluation circuit 163 stores the device difference information ID in the second device difference information register 162B as the second device difference information ID2.

Note that the device difference information evaluation circuit 163 is an example of an evaluation circuit in the accompanying claims.

Control Method of the Reference Signal Compensation Process

The control method of the reference signal compensation process according to this embodiment is described further below with reference to the flow chart in FIG. 3.

Figure 3:
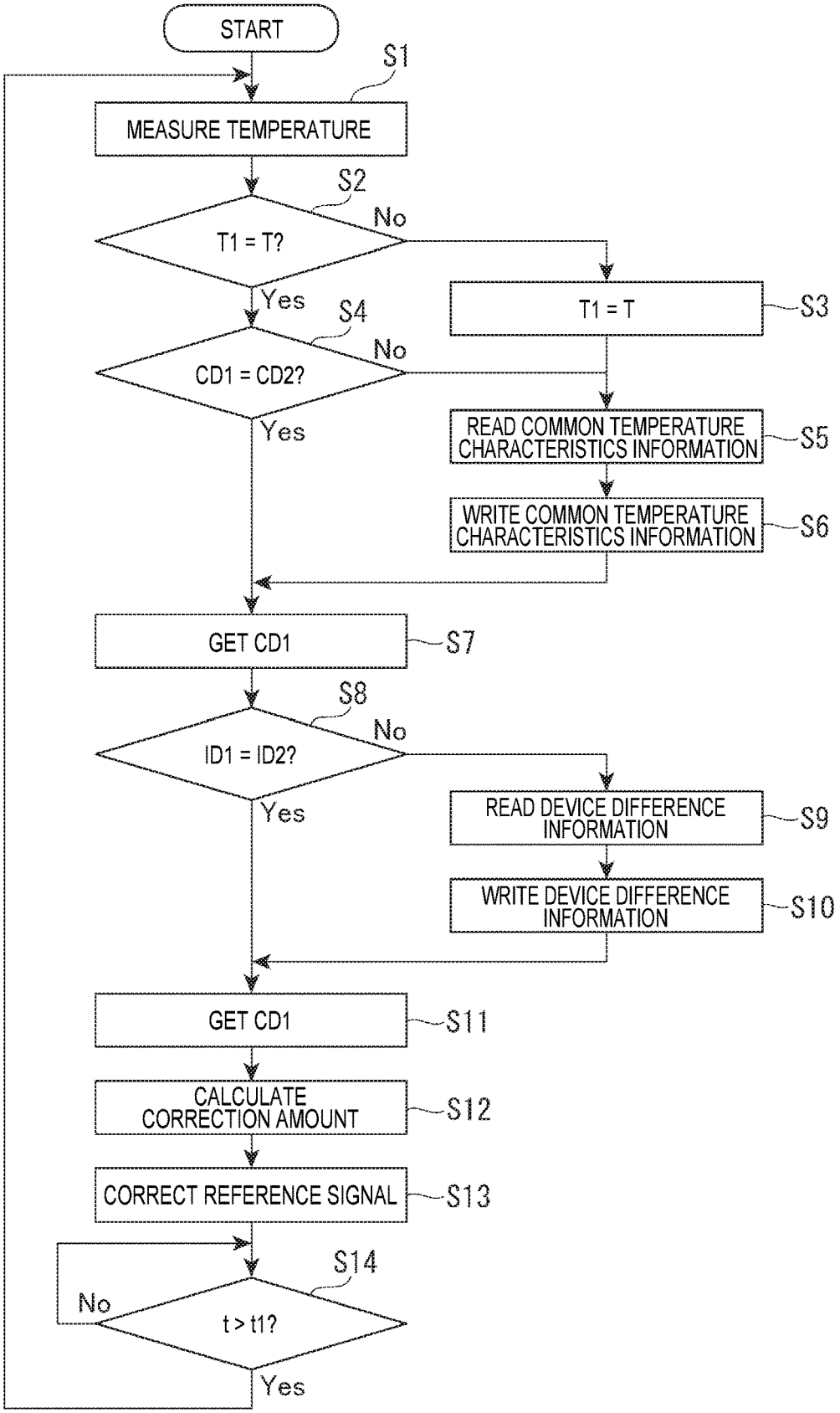
FIG. 3 is a flow chart describing the reference signal compensation process of the first embodiment.

As shown in FIG. 3, when the reference signal compensation process starts, the temperature measuring circuit 14, in step S1, measures the temperature and outputs temperature measurement information T to the arithmetic circuit 151 of the temperature compensation circuit 15.

Next, the arithmetic circuit 151, in step S2, determines whether or not the stored temperature measurement information T1 stored in the arithmetic circuit 151, and the temperature measurement information T that was input, are the same.

Note that in step S2 the stored temperature measurement information T1 and the temperature measurement information T being the same is not limited to an exact match, and they may be determined to match even when there is a difference between them of 0.5 or less, for example.

If the arithmetic circuit 151 determines No in step S2, the arithmetic circuit 151 in step S3 stores the temperature measurement information T that was input as the stored temperature measurement information T1. Control then goes to step S5 described below.

Note that in the first iteration of step S2 after the reference signal compensation process starts after the power turns on, for example, the stored temperature measurement information T1 is not stored in the arithmetic circuit 151. In this event, the arithmetic circuit 151 determines No in step S2 and goes to step S3.

If Yes is determined in step S2, the arithmetic circuit 151, in step S4, controls the common temperature characteristics information evaluation circuit 173 to determine whether or not the first common temperature characteristics information CD1 stored in the first common temperature characteristics information register 172A, and the second common temperature characteristics information CD2 stored in the second common temperature characteristics information register 172B, are the same.

In this instance the common temperature characteristics information CD that was read from the common temperature characteristics information memory 171 is stored in the first common temperature characteristics information register 172A and the second common temperature characteristics information register 172B. As a result, the first common temperature characteristics information CD1 and the second common temperature characteristics information CD2 are the same.

However, noise from a voltage drop in the IC 10, lightning, or the effects of impact on the timepiece 1, for example, may affect the data stored in the first common temperature characteristics information register 172A and the second common temperature characteristics information register 172B. The effect of such factors on the stored data is not necessarily the same in the first common temperature characteristics information register 172A and second common temperature characteristics information register 172B. As a result, when the data is affected by such factors, the first common temperature characteristics information CD1 and the second common temperature characteristics information CD2 are usually different. In this event, therefore, the arithmetic circuit 151 determines No in step S4.

When No is determined in step S4, the arithmetic circuit 151, in step S5, controls the common temperature characteristics information evaluation circuit 173 to read the common temperature characteristics information CD in the temperature measurement information T from the common temperature characteristics information memory 171.

Next, the arithmetic circuit 151, in step S6, controls the common temperature characteristics information evaluation circuit 173 to write the common temperature characteristics information CD read from the common temperature characteristics information memory 171 to the first common temperature characteristics information register 172A and second common temperature characteristics information register 172B.

Next, the arithmetic circuit 151, in step S7, acquires the first common temperature characteristics information CD1 written to the first common temperature characteristics information register 172A as the common temperature characteristics information CD. Note that, in step S7, the arithmetic circuit 151 may alternatively acquire the second common temperature characteristics information CD2 written to the second common temperature characteristics information register 172B as the common temperature characteristics information CD.

However, when Yes is determined in step S4, the arithmetic circuit 151, in step S7, acquires the first common temperature characteristics information CD1 written to the first common temperature characteristics information register 172A as the common temperature characteristics information CD. More specifically, in this case the arithmetic circuit 151 does not read from the common temperature characteristics information memory 171.

Note that as described above, the arithmetic circuit 151 may also acquire the second common temperature characteristics information CD2 written to the second common temperature characteristics information register 172B as the common temperature characteristics information CD.

In this embodiment the current consumption is approximately 4600 pA/kHz when reading the common temperature characteristics information CD from common temperature characteristics information memory 171 configured by ROM.

However, when reading the first common temperature characteristics information CD1 and second common temperature characteristics information CD2 from the first common temperature characteristics information register 172A and second common temperature characteristics information register 172B, current consumption is approximately 230 pA/kHz.

As a result, when Yes is determined in step S4, the current consumption required to read the common temperature characteristics information CD can be greatly reduced because the arithmetic circuit 151 does not read from common temperature characteristics information memory 171.

Next, the arithmetic circuit 151, in step S8, controls the device difference information evaluation circuit 163 to determine whether or not the first device difference information ID1 stored in the first device difference information register 162A, and the second device difference information ID2 stored in the second device difference information register 162B, are the same.

Similarly to the first common temperature characteristics information CD1 and second common temperature characteristics information CD2 described above, the first device difference information ID1 and the second device difference information ID2 are not necessarily the same. If not the same, the arithmetic circuit 151 determines No in step S8.

In addition, in the first iteration of step S8 after the reference signal compensation process starts after the power turns on, for example, the device difference information ID is not stored in the first device difference information register 162A and second device difference information register 162B. In this event, the arithmetic circuit 151 determines No in step S8.

When No is determined in step S8, the arithmetic circuit 151, in step S9, controls the device difference information evaluation circuit 163 to read the device difference information ID from the device difference information memory 161.

Then, in step S10, the arithmetic circuit 151 controls the device difference information evaluation circuit 163 to write the device difference information ID read from the device difference information memory 161 to the first device difference information register 162A and second device difference information register 162B.

Next, the arithmetic circuit 151, in step S11, acquires the first device difference information ID1 written to the first device difference information register 162A as the device difference information ID. Note that in step S11 the arithmetic circuit 151 may acquire the second device difference information ID2 written to the second device difference information register 162B as the device difference information ID.

However, if Yes is determined in step S8, the arithmetic circuit 151, in step S11, acquires the first device difference information ID1 written to the first device difference information register 162A as the device difference information ID. More specifically, in this case, the arithmetic circuit 151 does not read from device difference information memory 161.

As noted above, in this case the arithmetic circuit 151 may alternatively acquire the second device difference information ID2 written to the second device difference information register 162B as the device difference information ID.

In this embodiment, the current consumption is approximately 20000 pA/kHz when reading the device difference information ID from device difference information memory 161 configured by FAMOS. In contrast, current consumption is approximately 230 pA/kHz when reading the first device difference information ID1 and second device difference information ID2 from the first device difference information register 162A and second device difference information register 162B.

As a result, when Yes is determined in step S8, current consumption required to read the device difference information ID can be greatly reduced because the arithmetic circuit 151 does not read from device difference information memory 161.

Next, the arithmetic circuit 151, in step S12, calculates the rate compensation based on the common temperature characteristics information CD corresponding to the acquired device difference information ID and temperature measurement information T, and outputs the result to the regulator circuit 152.

Next, the regulator circuit 152, in step S13, corrects the reference signal output from the frequency divider 12 according to the compensation amount input from the arithmetic circuit 151.

Next, the arithmetic circuit 151, in step S14, determines if the elapsed time t since the temperature was measured in step S1 exceeds a previously set specific time t1. In this embodiment the specific time t1 is previously set to 160 seconds.

When No is determined in step S14, the arithmetic circuit 151 returns to step S14 and repeats step S14.

However, if Yes is determined in step S14, the arithmetic circuit 151 resets the elapsed time t and returns to step S1. As a result, measuring the temperature and adjusting the reference signal repeats every 160 seconds.

Effect of Embodiment 1

Effects of this embodiment are described below.

In this embodiment, when the first common temperature characteristics information CD1 stored in the first common temperature characteristics information register 172A and the second common temperature characteristics information CD2 stored in the second common temperature characteristics information register 172B are determined to be the same, the temperature compensation circuit 15 reads the first common temperature characteristics information CD1 from the first common temperature characteristics information register 172A and corrects the reference signal.

As a result, the current consumption required to read the common temperature characteristics information CD to correct the reference signal can be greatly reduced because the temperature compensation circuit 15 does not read the common temperature characteristics information CD from the common temperature characteristics information memory 171, which is a ROM device.

In addition, when the first common temperature characteristics information CD1 and second common temperature characteristics information CD2 are determined to be different, the temperature compensation circuit 15 reads the common temperature characteristics information CD from the common temperature characteristics information memory 171, stores the read common temperature characteristics information CD to the first common temperature characteristics information register 172A and second common temperature characteristics information register 172B, and corrects the reference signal based on the common temperature characteristics information CD.

As a result, when the first common temperature characteristics information CD1 and second common temperature characteristics information CD2 have been affected by a voltage drop, noise, physical shock, or other factor, the temperature compensation circuit 15 reads the common temperature characteristics information CD from the common temperature characteristics information memory 171 to correct the reference signal, and the reference signal can be appropriately corrected.

The timepiece 1 according to this embodiment can therefore reduce power consumption while maintaining the required timekeeping precision.

In this embodiment, when the first device difference information ID1 stored in the first device difference information register 162A and the second device difference information ID2 stored in the second device difference information register 162B are determined to be the same, the temperature compensation circuit 15 reads the first device difference information ID1 from the first device difference information register 162A and corrects the reference signal.

As a result, the current consumption required to read the device difference information ID to correct the reference signal can be greatly reduced because the temperature compensation circuit 15 does not read the device difference information ID from the device difference information memory 161, which is a FAMOS device.

Also in this embodiment, when the first device difference information ID1 and second device difference information ID2 are determined to be different, the temperature compensation circuit 15 reads the device difference information ID from the device difference information memory 161, stores the read device difference information ID to the first device difference information register 162A and second device difference information register 162B, and corrects the reference signal based on the device difference information ID.

As a result, when the first device difference information ID1 and second device difference information ID2 have been affected by a voltage drop, noise, physical shock, or other factor, the temperature compensation circuit 15 reads the device difference information ID from the device difference information memory 161 to correct the reference signal, and the reference signal can be appropriately corrected.

The timepiece 1 according to this embodiment can therefore reduce power consumption while maintaining the required timekeeping precision.

In this embodiment the motor control circuit 13 controls driving the hands 4A to 4C by the motor 40 and wheel train 50 based on the reference signal corrected by the temperature compensation circuit 15. The timepiece 1 can therefore maintain the precision required for a so-called year difference timepiece.

Furthermore, because the device difference information memory 161 is configured using FAMOS in this embodiment, the device difference information ID can be written even after the IC 10 is designed.

Furthermore, because the common temperature characteristics information memory 171 is configured by ROM in this embodiment, the space occupied by the storage in the IC 10 can be reduced. More specifically, because the structure of ROM is simple, it has a high degree of integration and occupies little space compared with a configuration using nonvolatile memory that can be rewritten by applying voltage for the common temperature characteristics information memory 171.

Embodiment 2

A second embodiment of the present disclosure is described next based on FIG. 4 and FIG. 5. The timepiece 1A according to the second embodiment differs from the first embodiment in being an electronically controlled mechanical timepiece having a generator 70A and spring 80A.

Note that configurations that are the same or similar in this second embodiment and the foregoing first embodiment are identified by like reference numerals and further description thereof is omitted.

Figure 4:
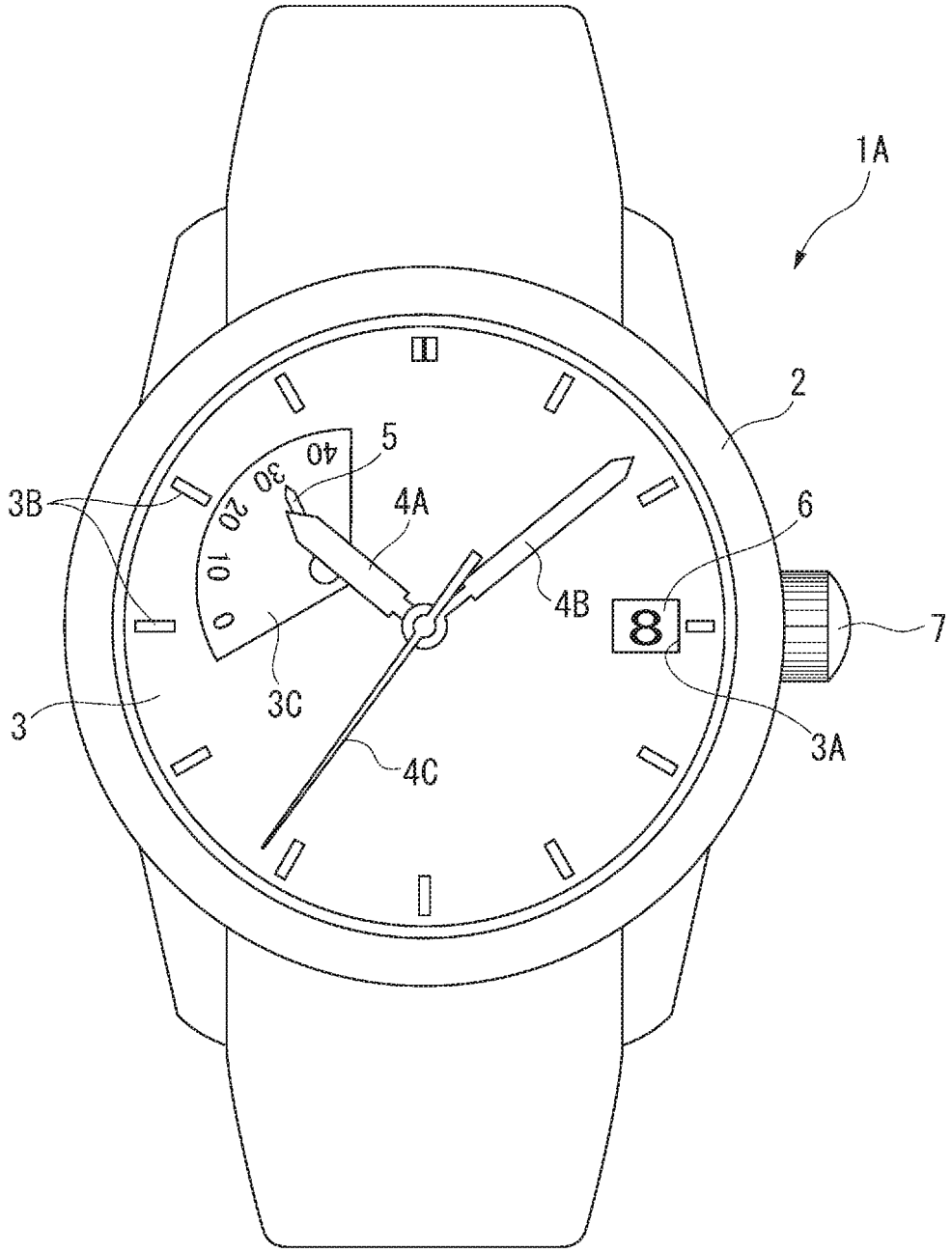
FIG. 4 is a front view of a timepiece according to the second embodiment.

FIG. 4 is a front view of the timepiece 1A according to the second embodiment.

As shown in FIG. 4, the timepiece 1A according to this embodiment has a power reserve indicator 5 for indicating the duration time. A fan-shaped subdial 3C on which the power reserve indicator 5 indicates the duration time is disposed to the dial 3.

Turning the crown 7 at the 0 stop position in this embodiment winds the spring 80A described below. The power reserve indicator 5 also moves in conjunction with winding the spring 80A. In the timepiece 1A according to this embodiment, a duration time of approximately 40 hours is assured when the spring 80A is fully wound.

Basic Timepiece Configuration

Figure 5:
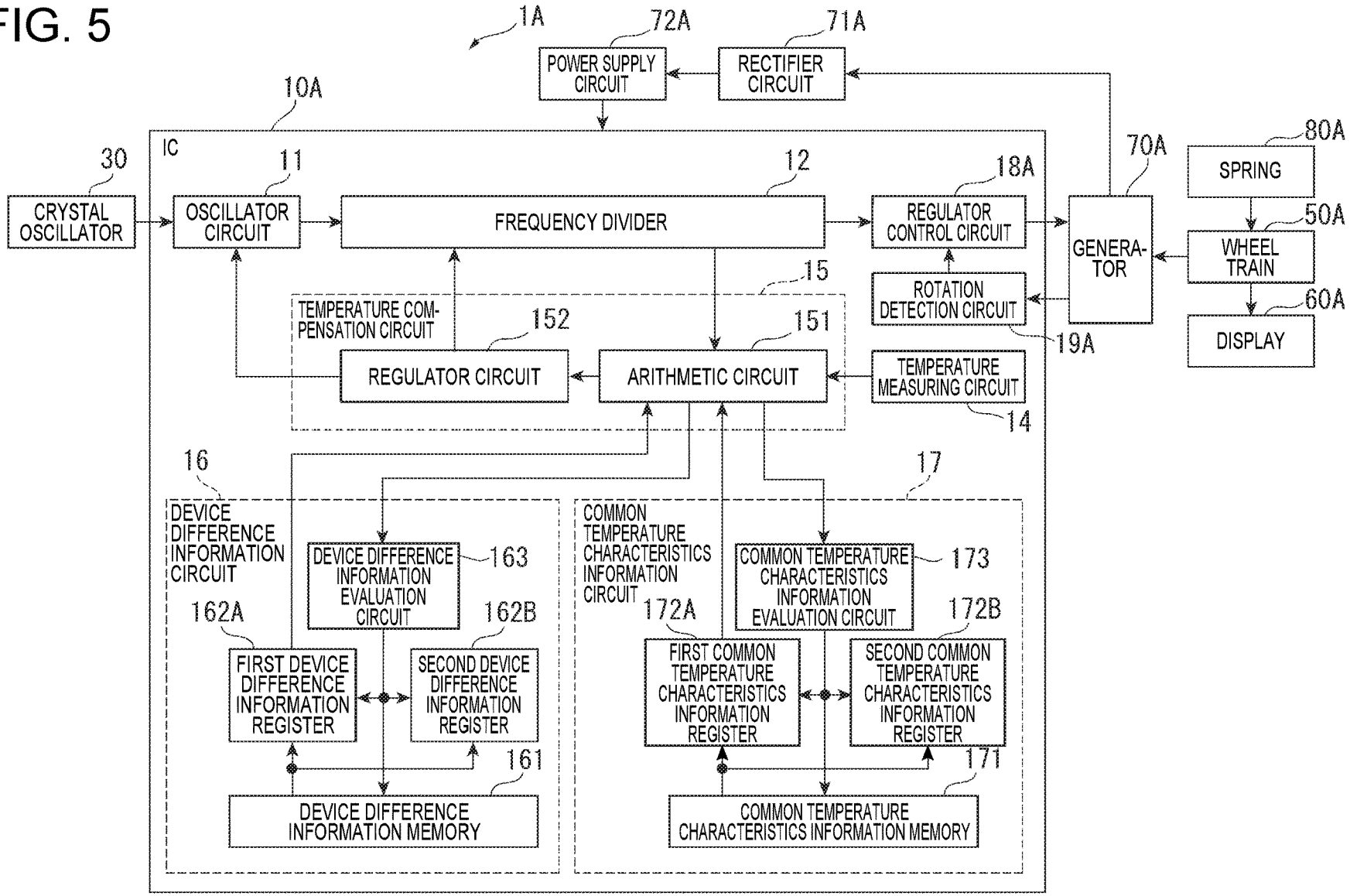
FIG. 5 is a block diagram illustrating the basic configuration of the timepiece according to the second embodiment.

FIG. 5 is a block diagram illustrating the basic configuration of the timepiece 1A.

As shown in FIG. 5, this timepiece 1A is an electronically controlled mechanical timepiece having an IC 10A, generator 70A, rectifier circuit 71A, power supply circuit 72A, spring 80A, wheel train 50A, and display 60A.

The wheel train 50A is connected to the spring 80A and the rotor not shown of the generator 70A. The wheel train 50A connects the rotor to the hands 4A to 4C and 5 shown in FIG. 4. As a result, the spring 80A drives the hands 4A to 4C and 5 through the wheel train 50A. Note that the wheel train 50A is an example of a drive mechanism in the accompanying claims.

The display 60A is configured by the hands 4A to 4C shown in FIG. 4, and displays the time. Note that in this embodiment the display 60A includes the power reserve indicator 5. Note that in FIG. 5 the IC 10A may be configured to include the rectifier circuit 71A. This configuration can reduce the parts count of the timepiece 1A.

The generator 70A includes a rotor not shown and a coil that produces induced electromotive force in conjunction with rotation of the rotor, and supplies electrical energy. The rotor of the generator 70A is driven through the wheel train 50A by the spring 80A. The generator 70A functions as a generator by the rotor turning to generate induced electromotive force and produce electricity.

A rectifier circuit 71A is connected to the generator 70A. As a result, the electrical energy supplied from the generator 70A is charged through the rectifier circuit 71A to a capacitor in the power supply circuit 72A. The IC 10A is then driven by the voltage produced at the ends of the capacitor of the power supply circuit 72A. Note that the power supply circuit 72A may also be a storage battery.

By providing a brake circuit not shown, the generator 70A may also function as a regulator. A brake control signal from a regulator control circuit 18A described below is input to the generator 70A, and the brake force is adjusted by the brake control signal.

IC

The IC 10A in this embodiment includes a regulator control circuit 18A and a rotation detection circuit 19A.

The rotation detection circuit 19A is configured by a wave shaping circuit and a monostable multivibrator not shown connected to the generator 70A, and outputs to the regulator control circuit 18A a rotation detection signal indicating the rotational frequency of the generator 70A.

The regulator control circuit 18A compares the rotation detection signal output from the rotation detection circuit 19A with a reference signal output from the frequency divider 12, and outputs a brake control signal for regulating the generator 70A to the generator 70A.

Note that in this embodiment the reference signal is a signal adjusted to the reference speed of the rotor during normal operation of the movement. Therefore, by outputting a brake control signal appropriate to the difference between the reference signal and the rotation detection signal corresponding to the rotational speed of the rotor, the regulator control circuit 18A adjusts the brake force of the braking circuit, and controls rotation of the rotor. In other words, the regulator control circuit 18A is an example of a regulator controller in the accompanying claims.

In this way, the regulator control circuit 18A of the timepiece 1A according to this embodiment controls a brake so that the frequency of the rotation detection signal detected by the rotation detection circuit 19A matches the reference signal output from the frequency divider 12.

As in the first embodiment described above, this embodiment also has a temperature measuring circuit 14, temperature compensation circuit 15, device difference information circuit 16 and common temperature characteristics information circuit 17. As a result, by correcting the reference signal output from the frequency divider 12 according to the temperature measurement information T, a highly precise reference signal can be maintained. In addition, because the rotational speed of the rotor can also be precisely maintained, the hands 4A to 4C of the display 60A connected to the rotor through the wheel train 50A can accurately indicate the time.

The timepiece 1A can therefore maintain the precision required for a so-called year difference timepiece while being an electronically controlled mechanical timepiece using a spring 80A as the power source.

Effect of Embodiment 2

Effects of this embodiment are described below.

A timepiece 1A including a generator 70A and spring 80A according to this embodiment also has a temperature compensation circuit 15, device difference information circuit 16, and common temperature characteristics information circuit 17 as in the first embodiment described above.

As a result, because the power consumption required to correct the reference signal can be reduced, output voltage sufficient to drive the IC 10A can be acquired even when the mechanism energy supplied from the spring 80A is weak. The duration time of the timepiece 1A, which is an electronically controlled mechanical timepiece, can be increased.

Other Embodiments

The present invention is not limited to the embodiments described above, and includes variations and modifications within the scope of the accompanying claims.

In the embodiments described above the IC 10, 10A includes a device difference information circuit 16 and common temperature characteristics information circuit 17, but the invention is not so limited.

For example, the IC 10, 10A may be configured with a device difference information circuit 16 and without the common temperature characteristics information circuit 17. In this case, the temperature compensation circuit 15 is configured to correct the reference signal based on the device difference information ID.

Further alternatively, the IC 10, 10A may be configured with the common temperature characteristics information circuit 17 and without the device difference information circuit 16. In this case, the temperature compensation circuit 15 is configured to correct the reference signal based on the temperature measurement information T and common temperature characteristics information CD.

In the embodiments described above the device difference information circuit 16 has two registers, a first device difference information register 162A and a second device difference information register 162B, but the invention is not so limited.

For example, the device difference information circuit 16 may be configured with three or more registers to store the device difference information ID. In this case, the device difference information evaluation circuit 163 may be configured to determine whether or not the device difference information ID stored in all of the registers is the same. This enables even more appropriately correcting the reference signal.

In the embodiments described above the common temperature characteristics information circuit 17 has two registers, a first common temperature characteristics information register 172A and a second common temperature characteristics information register 172B, but the invention is not so limited.

For example, the common temperature characteristics information circuit 17 may be configured with three or more registers to store the common temperature characteristics information CD. In this case, the common temperature characteristics information evaluation circuit 173 may be configured to determine whether or not the common temperature characteristics information CD stored in all of the registers is the same. This enables even more appropriately correcting the reference signal.

The device difference information memory 161 in the foregoing embodiments is configured by a FAMOS device, but the invention is not so limited. For example, the device difference information memory 161 may be configured by an EEPROM device or other type of nonvolatile memory.

The common temperature characteristics information memory 171 in the foregoing embodiments is configured by ROM, but the invention is not so limited. For example, the common temperature characteristics information memory 171 may be configured by a FAMOS device or other type of nonvolatile memory.

In the embodiments described above the device difference information memory 161 and common temperature characteristics information memory 171 are disposed to the IC 10, 10A, but the invention is not so limited. For example, the device difference information memory 161 and common temperature characteristics information memory 171 may be provided as memory devices separate from the IC 10, 10A.

The timepiece 1 according to the first embodiment of the invention is also not limited to an analog quartz timepiece, and may also be applied to a digital quartz timepiece, or a combination quartz timepiece having the display functions of both an analog quartz timepiece and a digital quartz timepiece.

The timepieces 1, 1A according to the foregoing embodiments are wristwatches, but may be table clocks or other type of timepiece.

In the embodiments described above the device difference information circuit 16 is configured to output device difference information ID based on individual differences in the crystal oscillator 30 and temperature measuring circuit 14, but the invention is not so limited.

For example, the device difference information circuit 16 may be configured to output crystal oscillator device difference information based on individual differences of the crystal oscillator 30, or temperature measuring circuit device difference information based on individual differences in the temperature measuring circuit 14.

The IC 10, 10A may also be configured with a crystal oscillator difference information circuit that can output device difference information related to the crystal oscillator, and a temperature measuring circuit difference information circuit that can output device difference information related to the temperature measuring circuit.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A timepiece comprising:

a crystal oscillator;

an oscillator circuit that causes the crystal oscillator to oscillate;

a frequency divider that frequency divides the oscillation signal output from the oscillator circuit, and outputs a reference signal;

a nonvolatile memory that stores information related to a temperature characteristic of the oscillation frequency of the crystal oscillator;

multiple registers configured to the information;

a temperature measuring circuit that measures temperature and acquires temperature measurement information;

an evaluation circuit configured to determine whether or not the information stored in the multiple registers is the same; and a temperature compensation circuit configured to read the information from one of the registers and correct the reference signal based on the read information and the temperature measurement information when the evaluation circuit determines the information stored in the multiple registers is the same, and when the evaluation circuit determines the information stored in the multiple registers is different, read the information from the nonvolatile memory and store the read information in the multiple registers, and correct the reference signal based on the read information and the temperature measurement information.

2. The timepiece described in claim 1, wherein:

the nonvolatile memory includes common temperature characteristics information memory that stores common temperature characteristics information that is common to the crystal oscillator as the information;

the registers include multiple common temperature characteristics information registers configured to store the common temperature characteristics information;

the evaluation circuit includes a common temperature characteristics information evaluation circuit configured to determine whether or not the common temperature characteristics information stored in the multiple common temperature characteristics information registers is the same; and the temperature compensation circuit corrects the reference signal based on the common temperature characteristics information and the temperature measurement information.

3. The timepiece described in claim 1, wherein:

the nonvolatile memory includes device difference information memory that stores device difference information related to a temperature characteristic of the crystal oscillator as the information;

the registers include multiple device difference information registers that store the device difference information;

the evaluation circuit includes a device difference information evaluation circuit configured to determine whether or not the device difference information stored in the multiple device difference information registers is the same; and the temperature compensation circuit corrects the reference signal based on the device difference information.

4. The timepiece described in claim 1, further comprising:
hands configured to display time;
a drive mechanism configured to drive the hands; and
a drive controller configured to drive the hands by the drive mechanism based on the reference signal corrected by the temperature compensation circuit.

5. The timepiece described in claim 2, further comprising:
hands configured to display time;
a drive mechanism configured to drive the hands; and
a drive controller configured to drive the hands by the drive mechanism based on the reference signal corrected by the temperature compensation circuit.

6. The timepiece described in claim 3, further comprising:
hands configured to display time;
a drive mechanism configured to drive the hands; and
a drive controller configured to drive the hands by the drive mechanism based on the reference signal corrected by the temperature compensation circuit.

7. The timepiece described in claim 1, further comprising:
a spring;
a generator that is driven by a drive mechanism connected to the spring and produces power;
hands that connect to the drive mechanism and display time; and
a regulator controller configured to control rotation of the generator based on the reference signal corrected by the temperature compensation circuit.

8. The timepiece described in claim 2, further comprising:
a spring;
a generator that is driven by a drive mechanism connected to the spring and produces power;
hands that connect to the drive mechanism and display time; and
a regulator controller configured to control rotation of the generator based on the reference signal corrected by the temperature compensation circuit.

9. The timepiece described in claim 3, further comprising:
a spring;
a generator that is driven by a drive mechanism connected to the spring and produces power;
hands that connect to the drive mechanism and display time; and
a regulator controller configured to control rotation of the generator based on the reference signal corrected by the temperature compensation circuit.

10. A timepiece comprising:
a crystal oscillator;
an oscillator circuit that causes the crystal oscillator to oscillate;
a frequency divider that frequency divides the oscillation signal output from the oscillator circuit, and outputs a reference signal;
a common temperature characteristics information memory that stores common temperature characteristics information that is common to the crystal oscillator, the common temperature characteristics information memory being a nonvolatile memory;
a device difference information memory that stores device difference information related to a temperature characteristic of the crystal oscillator, the device difference information memory being a nonvolatile memory;
multiple common temperature characteristics information registers configured to store the common temperature characteristics information;
multiple device difference information registers that store the device difference information;
a common temperature characteristics information evaluation circuit configured to determine whether or not the common temperature characteristics information stored in the multiple common temperature characteristics information registers is the same;
a device difference information evaluation circuit configured to determine whether or not the device difference information stored in the multiple device difference information registers is the same;
a temperature compensation circuit configured to
read the common temperature characteristics information from one of the common temperature characteristics information registers when the common temperature characteristics information evaluation circuit determines the common temperature characteristics information stored in the multiple common temperature characteristics information registers is the same,
read the common temperature characteristics information from the common temperature characteristics information memory and store the read common temperature characteristics information in the multiple common temperature characteristics registers when the common temperature characteristics evaluation circuit determines the common temperature characteristics information stored in the multiple common temperature characteristics registers is different,
read the device difference information from one of the device difference information registers when the device difference information evaluation circuit determines the device difference information stored in the multiple device difference information registers is the same,
read the device difference information from the device difference information memory and store the read device difference information in the multiple device difference information registers when the device difference information evaluation circuit determines the device difference information stored in the multiple device difference information registers is different, and
correct the reference signal based on the read common temperature characteristics information, the read device difference information, and the temperature measurement information.

11. The timepiece described in claim 10, further comprising:
hands configured to display time;
a drive mechanism configured to drive the hands; and
a drive controller configured to drive the hands by the drive mechanism based on the reference signal corrected by the temperature compensation circuit.

12. The timepiece described in claim 11, further comprising:
a spring;
a generator that is driven by a drive mechanism connected to the spring and produces power;
hands that connect to the drive mechanism and display time; and
a regulator controller configured to control rotation of the generator based on the reference signal corrected by the temperature compensation circuit.

13. A control method of a timepiece having a crystal oscillator;
an oscillator circuit that causes the crystal oscillator to oscillate;

a frequency divider that frequency divides the oscillation signal output from the oscillator circuit, and outputs a reference signal;

a nonvolatile memory that stores information related to a temperature characteristic of the oscillation frequency of the crystal oscillator;

multiple registers configured to the information; and a temperature measuring circuit that measures temperature and acquires temperature measurement information, the control method comprising steps of:

determining whether or not the information stored in the multiple registers is the same;

reading the information from one of the registers and correcting the reference signal based on the read information and the temperature measurement information when the information stored in the multiple registers is determined the same; and reading the information from the nonvolatile memory, storing the read information in the multiple registers, and correcting the reference signal based on the read information and the temperature measurement information when the information stored in the multiple registers is determined different.

14. The control method of a timepiece described in claim 13, wherein the nonvolatile memory stores common temperature characteristics information that is common to the crystal oscillator as the information, and the registers include multiple common temperature characteristics information registers configured to store the common temperature characteristics information, the control method further comprising steps of:

correcting the reference signal based on the common temperature characteristics information read from one of the multiple common temperature characteristics information registers and the temperature measurement information when the common temperature characteristics information stored in the multiple common temperature characteristics information registers is determined the same; and reading the common temperature characteristics information from the nonvolatile memory, storing the read common temperature characteristics information in the multiple common temperature characteristics information registers, and correcting the reference signal based on the common temperature characteristics information and the temperature measurement information when the common temperature characteristics information stored in the multiple common temperature characteristics information registers is determined different.

15. The control method of a timepiece described in claim 13, wherein the nonvolatile memory stores device difference information related to a temperature characteristic of the crystal oscillator as the information, and the registers include multiple device difference information registers that store the device difference information, the control method further comprising steps of:

correcting the reference signal based on the device difference information read from one of the multiple device difference information registers and the temperature measurement information when the device difference information stored in the multiple device difference information registers is determined the same; and reading the device difference information from the nonvolatile memory, writing the read device difference information to the multiple device difference information registers, and correcting the reference signal based on the written device difference information and the temperature measurement information when the device difference information stored in the multiple device difference information registers is determined different.

* * * * *